US008116640B2

(12) United States Patent
Zona et al.

(10) Patent No.: US 8,116,640 B2
(45) Date of Patent: Feb. 14, 2012

(54) APPARATUS AND METHOD FOR SENSING PHOTORECEPTOR FAILURE IN A XEROGRAPHIC PRINTING APPARATUS

(75) Inventors: Michael F. Zona, Holley, NY (US); Richard L. Howe, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 428 days.

(21) Appl. No.: 12/490,842

(22) Filed: Jun. 24, 2009

(65) Prior Publication Data

US 2010/0329701 A1 Dec. 30, 2010

(51) Int. Cl.
*G03G 15/00* (2006.01)

(52) U.S. Cl. ..... 399/26

(58) Field of Classification Search ..... 399/26, 399/31, 49, 72, 14
See application file for complete search history.

(56) References Cited

U.S. PATENT DOCUMENTS 5,285,241 A * 2/1994 Scheuer ..... 399/72
5,383,005 A * 1/1995 Thompson et al.

FOREIGN PATENT DOCUMENTS

JP 01109374 A * 4/1989

* cited by examiner

*Primary Examiner* — Susan Lee
(74) *Attorney, Agent, or Firm* — Ronald E. Prass, Jr.; Prass LLP

(57) ABSTRACT

An apparatus (100) and method (200) that senses photoreceptor failure in a xerographic printing apparatus is disclosed. The xerographic printing apparatus can include a rotatable photoreceptor (110) having a photoreceptor surface (111), a cleaning device (124) for removing marking material from the photoreceptor, and a printing apparatus controller (150) that controls operations of the xerographic printing apparatus. The method can include charging (220) the photoreceptor surface to a fixed voltage. The method can include discharging (230) at least a portion of the charged photoreceptor surface to an exposed voltage. The method can include developing (240) the discharged portion of the photoreceptor surface by providing a cleaning field between the charged photoreceptor surface fixed voltage and a developing bias voltage. The method can include reducing (250) the cleaning field. The method can include generating (260) a developed image on the photoreceptor using the reduced cleaning field. The method can include scanning (270) the developed image after reducing the cleaning field, where the developed image can be scanned using a sensor to generate a scanned image.

20 Claims, 3 Drawing Sheets

APPARATUS AND METHOD FOR SENSING PHOTORECEPTOR FAILURE IN A XEROGRAPHIC PRINTING APPARATUS

BACKGROUND

Disclosed herein is an apparatus and method that senses photoreceptor failure in a xerographic printing apparatus.

Presently, image output devices, such as xerographic printers, xerographic multifunction media devices, xerographic machines, and other xerographic devices produce images on media sheets, such as paper, substrates, transparencies, plastic, cardboard, or other media sheets. To produce an image, a developing device applies marking material, such as toner, ink jet ink, or other marking material, to a latent image on a photoreceptor. A transfer device transfers the developed marking material to a media sheet or image transfer belt to provide a developed image for fusing or a second transfer step. A fuser assembly then affixes or fuses the developed image to the media sheet by applying heat and/or pressure to the media sheet.

Unfortunately, a photoreceptor is subject to scratching caused by a cleaning device used to clean residual marking material from the photoreceptor after the first transfer step. In electrostatic brush cleaning devices, micro-arcing between the brush fibers and the photoreceptor surface increases the photoreceptor surface roughness, Rz. In blade cleaning architectures, scratches can be generated from contamination from paper fiber, toner agglomerates, toner additives, etc. in the blade/photoreceptor nip. The halftone uniformity and hence image quality is a direct function of the surface roughness of the photoreceptor. As the surface roughness increases, white streaks in halftone areas appear on the customer output. Thus, image quality suffers as the scratching caused by micro-arcing or blade contamination increases the photoreceptor surface roughness. Overcoating the photoreceptor significantly improves the life of the photoreceptor. However, photoreceptors are still replaced before the end of their usable life in order to maintain 90% reliability with 90% confidence.

For example, a current life limiter of xerographic units is photoreceptor scratching from Paschen breakdown that occurs between the photoreceptor drum and electrostatic cleaner brush fibers. Service engineers replace the photoreceptor device at a specific interval, or sooner if close to the cycle alarm, even if the device is still performing acceptably. System run cost can be reduced by extending the life of the photoreceptor to its near failure point, instead of replacing it at a fixed interval. While use of overcoated photoreceptors extends the life of the device and lowers the run cost, significant reductions can be achieved through sensing of the impending photoreceptor device failure.

Thus, there is a need for an apparatus and method that senses impending photoreceptor failure in a xerographic printing apparatus.

SUMMARY

An apparatus and method that senses photoreceptor failure in a xerographic printing apparatus is disclosed. The xerographic printing apparatus can include a rotatable photoreceptor having a photoreceptor surface, a cleaning device for removing marking material from the photoreceptor, and a printing apparatus controller that controls operations of the xerographic printing apparatus. The method can include charging the photoreceptor surface to a fixed voltage. The method can include discharging at least a portion of the charged photoreceptor surface to an exposed voltage. The method can include developing the discharged portion of the photoreceptor surface by providing a cleaning field between the charged photoreceptor surface fixed voltage and a developing bias voltage. The method can include reducing the cleaning field. The method can include generating a developed image on the photoreceptor using the reduced cleaning field. The method can include scanning the developed image after reducing the cleaning field, where the developed image is scanned using a sensor to generate a scanned image.

BRIEF DESCRIPTION OF THE DRAWINGS

In order to describe the manner in which advantages and features of the disclosure can be obtained, a more particular description of the disclosure briefly described above will be rendered by reference to specific embodiments thereof, which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
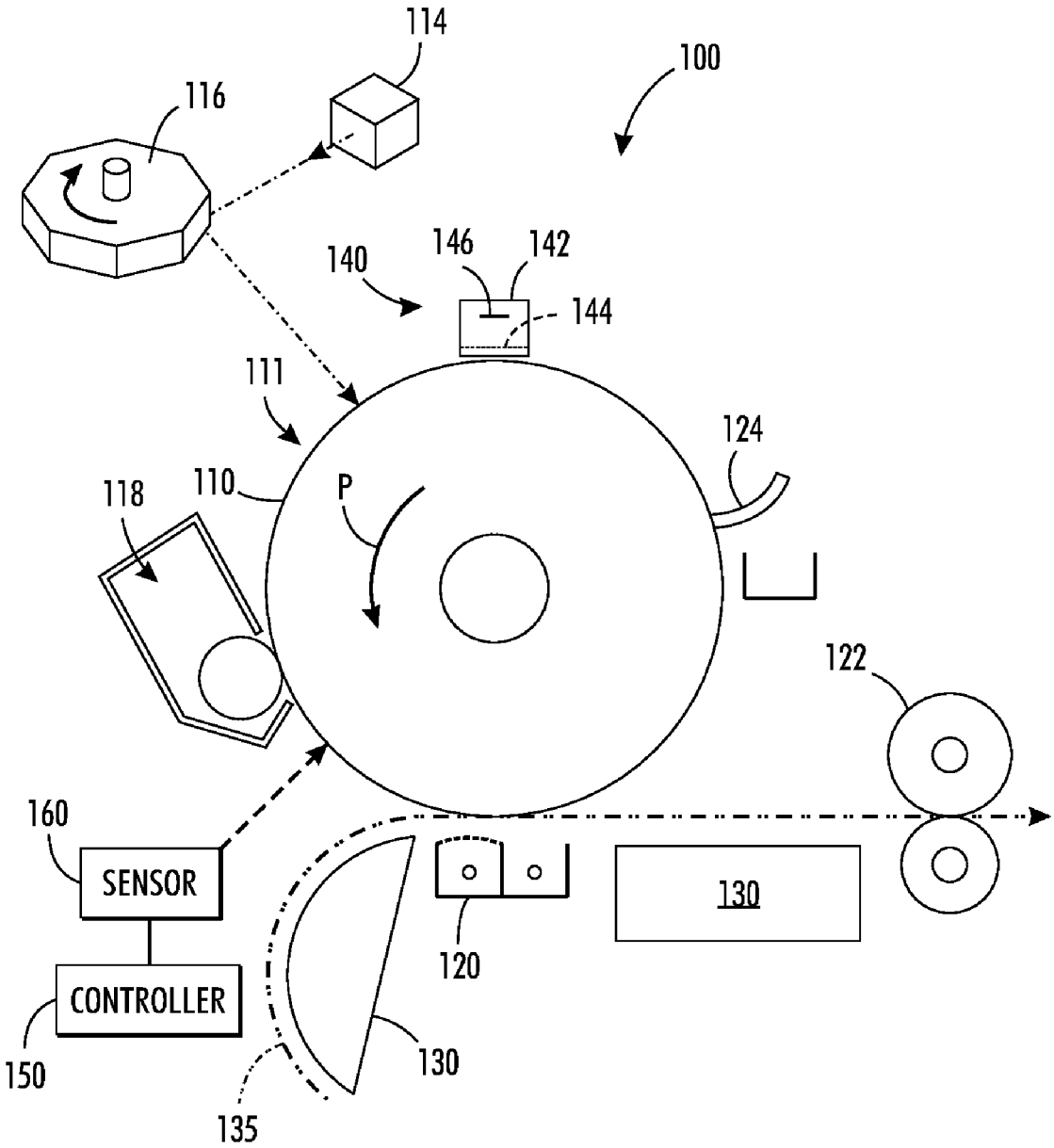
FIG. 1 is an exemplary illustration of an apparatus according to a possible embodiment.

The embodiments include a method of operating a xerographic printing apparatus. The xerographic printing apparatus can include a rotatable photoreceptor having a photoreceptor surface, a cleaning device for removing marking material from the photoreceptor, and a printing apparatus controller that controls operations of the xerographic printing apparatus. The method can include charging the photoreceptor surface to a fixed voltage. The method can include discharging at least a portion of the charged photoreceptor surface to an exposed voltage. The method can include developing the discharged portion of the photoreceptor surface by providing a cleaning field between the charged photoreceptor surface fixed voltage and a developing bias voltage. The method can include reducing the cleaning field. The method can include generating a developed image on the photoreceptor using the reduced cleaning field. The method can include scanning the developed image after reducing the cleaning field, where the developed image is scanned using a sensor to generate a scanned image.

For example, the method can include charging the surface of a photoreceptor with a charging device to a fixed voltage, $V_{high}$, exposing the photoreceptor to a exposed voltage, $V_{low}$, and developing the exposed latent image using a developing device biased to a voltage, $V_{bias}$, in between $V_{high}$. and $V_{low}$. The cleaning field can be defined as the difference in magnitude between the charged voltage, $V_{high}$, and the developing bias, $V_{bias}$. The method can include reducing the cleaning field of the xerographic printing apparatus to operate the xerographic printing apparatus using a reduced cleaning field. The method can include scanning the developed image after reducing the cleaning field, where the developed image is scanned using a sensor to generate a scanned image.

The embodiments further include a xerographic printing apparatus for sensing photoreceptor failure. The apparatus can include a photoreceptor including a photoreceptor surface, the photoreceptor configured to generate an image on media. The apparatus can include a charge device configured to charge the photoreceptor surface to a fixed voltage. The apparatus can include a raster output scanner configured to discharge at least a portion of the charged photoreceptor surface to an exposed voltage. The apparatus can include a developer unit configured to develop the discharged portion of the photoreceptor surface by providing a cleaning field between the charged photoreceptor surface fixed voltage and a developing bias voltage. The apparatus can include a printing apparatus controller configured to control operations of the xerographic printing apparatus, configured to reduce the cleaning field, and configured to generate a developed image on the photoreceptor using the reduced cleaning field. The apparatus can include a sensor configured to scan the developed image after reducing the cleaning field to generate a scanned image.

For example, the apparatus can include a marking system configured to generate a developed image on a photoreceptor. The apparatus can include a cleaning device configured to clean the photoreceptor. The apparatus can include a printing apparatus controller configured to control operations of the apparatus, configured to reduce the cleaning field of the printing apparatus to operate the photoreceptor and developing device using a reduced cleaning field, configured to generate an image on the photoreceptor, and configured to scan the image after reducing the cleaning field, where the image is scanned using a sensor to generate a scanned image.

The embodiments further include a method in a xerographic printing apparatus. The xerographic printing apparatus can include a photoreceptor having a photoreceptor surface, a photoreceptor cleaner that cleans the photoreceptor, and a printing apparatus controller that controls operations of the xerographic printing apparatus. The method can include charging an area of the photoreceptor surface to a fixed voltage. The method can include discharging at least a portion of the charged photoreceptor surface to an exposed voltage. The method can include developing the discharged portion of the photoreceptor surface by providing a cleaning field between the charged photoreceptor surface fixed voltage and a developing bias voltage. The method can include reducing the cleaning field. The method can include generating a developed image on the photoreceptor using the reduced cleaning field. The method can include scanning the developed image after reducing the cleaning field, where the image is scanned to generate a scanned image. The method can include determining upcoming photoreceptor failure based on a measured halftone uniformity of the scanned image.

For example, the xerographic printing apparatus can have a photoreceptor, a photoreceptor cleaner that cleans the photoreceptor, and a printing apparatus controller that controls operations of the xerographic printing apparatus. The method can include cleaning the photoreceptor with the photoreceptor cleaner using a cleaning field. The method can include reducing the cleaning field of the photoreceptor to operate the photoreceptor using a reduced cleaning field. The method can include generating an image on the photoreceptor while operating the photoreceptor using the reduced cleaning field. The method can include scanning the image using a sensor to generate a scanned image. The method can include determining upcoming photoreceptor failure based on the scanned image.

FIG. 1 is an exemplary illustration of a marking system 100, such as a xerographic printing apparatus. The marking system 100 may be in a printing apparatus, a printer, a multifunction media device, a xerographic machine, a laser printer, an ink jet printer, or any other device that generates an image on media. The marking system 100 can include a media transport 130 that can transport media or an intermediate transfer belt or drum 135. The marking system 100 can also include a photoreceptor 110. The photoreceptor 110 can also be part of a marking system including a photoreceptor 110, where the photoreceptor can have a photoreceptor charge transport surface. For example, the photoreceptor 110 can be a belt or drum and can include a photoreceptor charge transport surface 111 for forming electrostatic images thereon. The photoreceptor 110 can rotate in a process direction P and can generate an image on the media 135.

The marking system 100 can include a charge device 140, such as a scorotron, a charge roll, or any other electric field generation device, that can apply a voltage, $V_{high}$, to a photoconductor 110. For example, a scorotron 140 can include a scorotron shield 142, a scorotron charging grid 144, and a scorotron wire or pin array 146 located on an opposite side of the scorotron charging grid 144 from the photoconductor 110. The scorotron pin array 146 can be configured to generate an electric field. The scorotron charging grid 144 and the scorotron pin array 146 can be configured to generate a surface potential on the photoconductor 110.

In a more detailed operation, the charge device 140 can charge the photoreceptor 110 surface by imparting an electrostatic charge on the surface of the photoreceptor 110 as the photoreceptor 110 rotates. A raster output scanner, such as a laser source, a Light Emitting Diode (LED) bar, or other relevant device, can discharge selected portions of the photoreceptor 110 in a configuration corresponding to the desired image to be printed. For example, a raster output scanner can discharge a latent image to a more positive voltage, $V_{low}$. As a further example, a raster output scanner can include a laser source 114 and a rotatable mirror 116, which can act together to discharge certain areas of the surface of the photoreceptor 110 according to a desired image to be printed. Other elements can be used instead of a laser source 114 to selectively discharge the charge-retentive surface, such as an LED bar, a light-lens system, or other elements that can discharge a charge-retentive surface. The laser source 114 can be modulated in accordance with digital image data fed into it, and the rotatable mirror 116 can cause the modulated beam from the laser source 114 to move in a fast-scan direction perpendicular to the process direction P of the photoreceptor 110.

After certain areas of the photoreceptor 110 are discharged by the laser source 114, a developer unit 118 can develop an exposed latent image by applying a voltage bias, $V_{bias}$, to the developer unit 118 at a magnitude in between $V_{high}$. and $V_{low}$. The developer unit 118 can cause a supply of marking material, such as dry toner, to contact or otherwise approach the exposed latent image on the surface of the photoreceptor 110. A transfer station 120 can then cause the toner adhering to the photoreceptor 110 to be electrically transferred to the media 135, such as paper, plastic, or other media, or to an intermediate transfer belt or drum to form the image thereon. The media 135 with the toner image thereon can then be passed through a fuser 122, which can cause the toner to melt, or fuse, into the media 135 to create the permanent image. A cleaning device 124 can include at least one electrostatic cleaning brush coupled to the photoreceptor charge transport surface 111, or can include a rubber cleaning blade in contact with the surface to scrape any residual toner from the photoreceptor surface after the transfer step. For example, a cleaning device 124, such as electrostatic brushes or an equivalent device, can clean the photoreceptor 110 using an electric field generated between the fibers of the brush 140 and the residual toner on the photoreceptor surface after the transfer step.

The marking system 100 can include a printing apparatus controller 150 configured to control operations of the printing marking system 100. The printing apparatus controller 150 can be coupled to the charge device 140, the photoreceptor 110, and other elements of the marking system 100. The printing apparatus controller 150 can be configured to reduce the charged voltage, $V_{high}$, of the photoreceptor 110 to operate the marking system 100 using a reduced cleaning field. For example, the printing apparatus controller 150 can reduce the cleaning field of the marking system 100 by reducing a photoreceptor charge voltage generated using a scorotron. The photoreceptor controller 150 can reduce the cleaning field of the marking system 100 to operate using a reduced cleaning field to decrease halftone uniformity.

The printing apparatus controller 150 can be configured to determine upcoming photoreceptor failure based on the reduced cleaning field. For example, the printing apparatus controller 150 can be configured to determine upcoming photoreceptor failure based on the decreased halftone uniformity. The printing apparatus controller 150 can be one module or can include multiple modules configured to perform different functions. The multiple modules can be in one location or at different locations in the printing marking system 100.

The printing apparatus controller 150 can be configured to generate an image on the photoreceptor 110 while operating the photoreceptor 110 using the reduced cleaning field. The printing marking system 100 can include a sensor 160 that can be configured to scan the developed image to generate a scanned image. The printing apparatus controller 150 can then determine upcoming photoreceptor failure based on the scanned image. For example, the sensor 160 can be a full width array sensor that can scan a halftone image on the photoreceptor 110, and the printing apparatus controller 150 can determine the halftone image uniformity of the developed image. The printing apparatus controller 150 can then determine an upcoming photoreceptor failure based on the halftone uniformity of the developed image exceeding a predetermined threshold. The sensor 160 may also be a small sensor focused on one small area of photoreceptor 110, may be a sensor and a lens, may be a charge-coupled device, or may be any other sensor useful for sensing an image on a photoreceptor. The printing apparatus controller 150 can also determine upcoming photoreceptor failure by determining that image uniformity has reached a failure point based on the scanned image.

As a further example, the printing apparatus controller 150 can be configured to develop the latent image on the photoreceptor 110 while operating the marking system 100 using the reduced cleaning field. The printing apparatus controller 150 can take multiple measurements of the image using the sensor 160. The printing apparatus controller 150 can then determine photoreceptor failure by projecting upcoming photoreceptor failure based on the multiple measurements.

The printing apparatus controller 150 can be configured to output an indicator that indicates upcoming photoreceptor replacement. The marking system 100 can include an output module (not shown) that can be a display, an audio output, a transceiver, or any other module that can output an indicator that indicates the need for an upcoming photoreceptor replacement.

Figure 2:
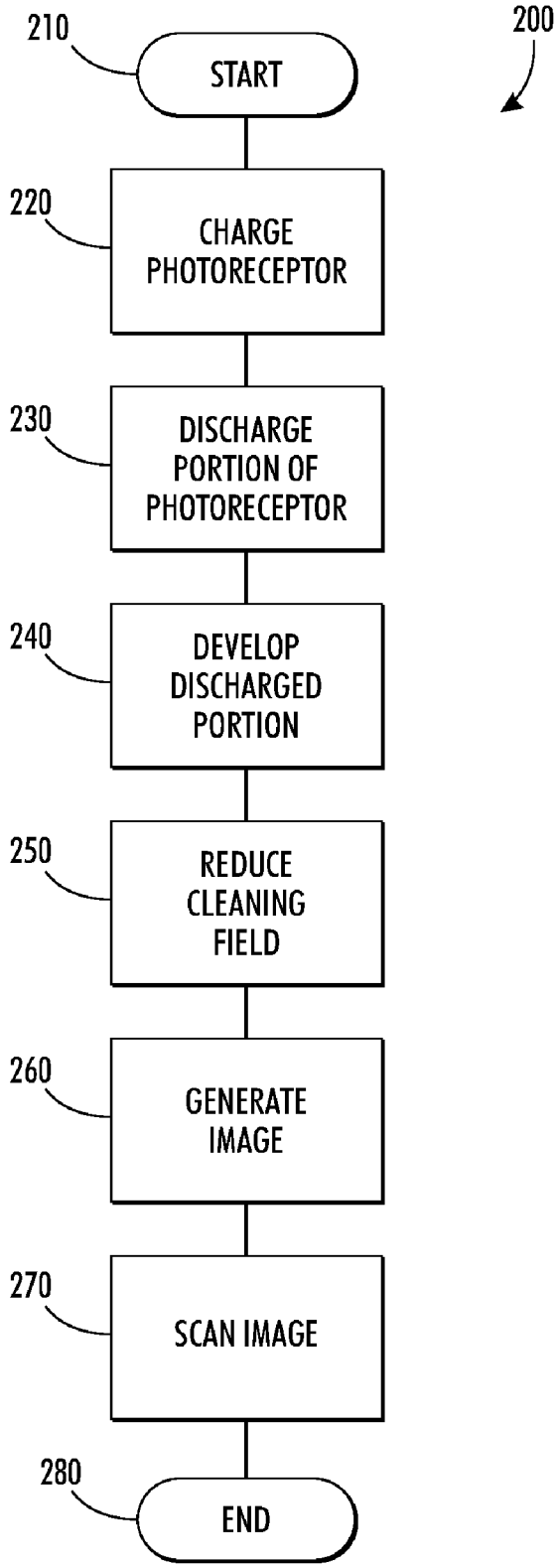
FIG. 2 is an exemplary flowchart of a method according to a possible embodiment.

FIG. 2 illustrates an exemplary flowchart 200 of a method in a xerographic printing apparatus, such as the marking system 100, including a rotatable photoreceptor having a photoreceptor surface, a cleaning device for removing marking material from the photoreceptor, and a printing apparatus controller that controls operations of the xerographic printing apparatus. The method starts at 210. At 220, the photoreceptor surface can be charged to a fixed voltage. At 230, at least a portion of the charged photoreceptor surface can be discharged to an exposed voltage. At 240, the discharged portion of the photoreceptor surface can be developed by providing a cleaning field between the charged photoreceptor surface fixed voltage and a developing bias voltage. At 250, the cleaning field can be reduced. At 260, a developed image can be generated on the photoreceptor using the reduced cleaning field. At 270, the developed image can be scanned using a sensor to generate a scanned image.

For example, the photoreceptor can be charged to voltage, $V_{high}$, using a charge device. An exposing device can discharge the latent image on the charge surface to an exposed voltage, $V_{low}$. The latent image can be developed with marking material using a developing device that can be biased at $V_{bias}$. between the charged voltage and the exposed voltage. The cleaning field can be the difference between the charged voltage, $V_{high}$, and the bias voltage, $V_{bias}$. The cleaning field of the marking system can be reduced to operate the photoreceptor using a reduced cleaning field. The reduced cleaning field can be less than the cleaning field that is used when operating the marking system during normal customer operating conditions. For example, during normal operation, the marking system may use a cleaning field of approximately 120. V. The photoreceptor charged voltage can be reduced by a certain percentage or by a certain number of volts. For example, the charged voltage can be reduced by 5-20% or by 5-25. V or more. The marking system may then operate using a reduced cleaning field of approximately 95-115. V or less. Upcoming photoreceptor failure can be determined based on the reduced cleaning field. At 280, the method can end.

Figure 3:
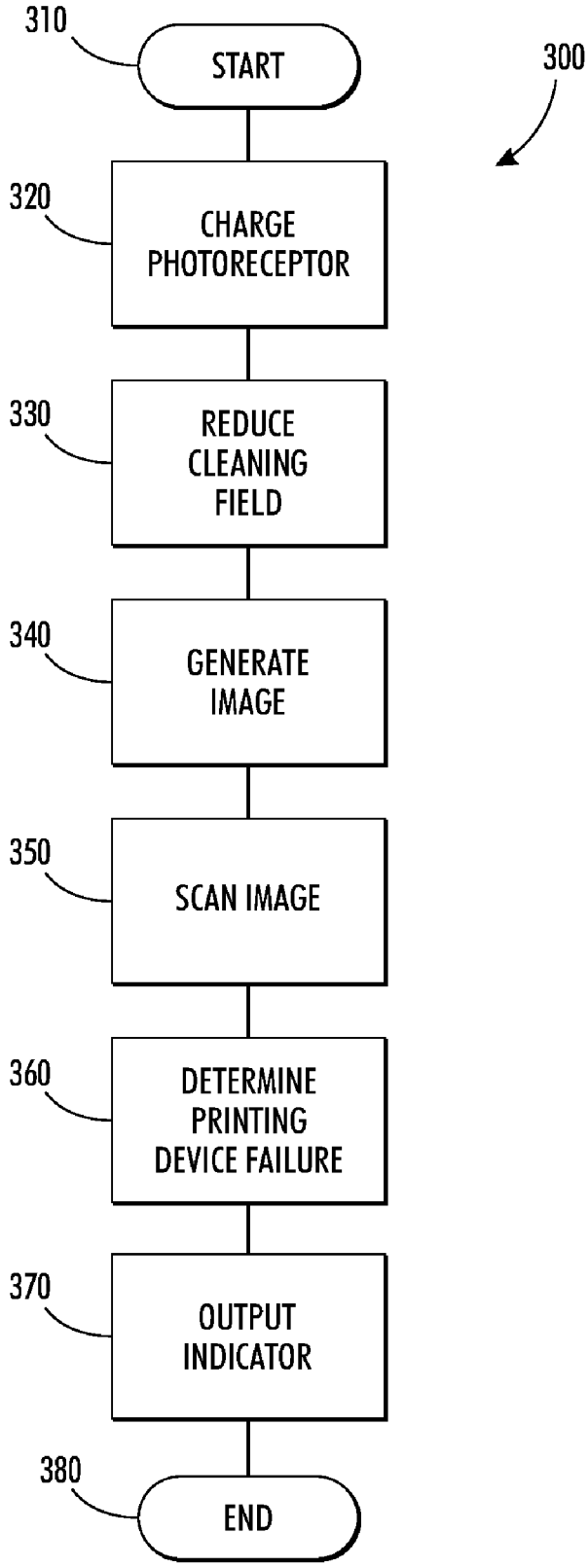
FIG. 3 is an exemplary flowchart of a method according to a possible embodiment.

FIG. 3 illustrates an exemplary flowchart 300 of a method in a printing apparatus, such as the marking system 100, according to a related embodiment. The printing apparatus can include a photoreceptor, a cleaning device that cleans the photoreceptor, and a printing apparatus controller that controls operations of the printing apparatus. The photoreceptor can be a marking system including a photoreceptor, the photoreceptor having a photoreceptor charge transport surface. The cleaning device can be at least one electrostatic cleaning brush coupled to the photoreceptor charge transport surface.

The method starts at 310. At 320, the photoreceptor can be charged to voltage, $V_{high}$, using a charge device. An exposing device discharges the latent image in the charge surface to an exposed voltage, $V_{low}$. The latent image is developed with marking material using developing device that is biased between the charged voltage and the exposed voltage, called $V_{bias}$. The cleaning field is the difference between the charged voltage, $V_{high}$, and the bias voltage, $V_{bias}$. At 330, the cleaning field of the marking system can be reduced to operate the marking system using a reduced cleaning field to decrease halftone uniformity.

At 340, an image can be generated on the photoreceptor while operating the photoreceptor using the reduced cleaning field. At 350, the image can be scanned using a sensor to generate a scanned image. The sensor can scan a halftone image. Also, a sensor can take multiple measurements of the image.

At 360, upcoming photoreceptor failure can be determined based on the reduced cleaning field. Upcoming photoreceptor failure can also be determined based on the scanned image. Upcoming photoreceptor failure can also be determined by calculating a halftone uniformity metric from the scanned image and then by determining upcoming photoreceptor failure based on the uniformity metric exceeding a predetermined threshold. Upcoming photoreceptor failure can also be determined by determining that image uniformity has reached a failure point based on the scanned image. Upcoming photoreceptor failure can also be determined by projecting upcoming photoreceptor failure based on multiple measurements. For example, multiple measurements can be taken by scanning the image using a sensor to generate a scanned image. As a further example, continual measurements can be made and a projection point in the future can be calculated to inform a user when a future photoreceptor failure may occur.

At 370, an indicator can be output that indicates upcoming photoreceptor replacement. The indicator can indicate the upcoming photoreceptor replacement by indicating that the photoreceptor should be replaced or by indicating a projected future time or event at which the photoreceptor should be replaced. At 380, the method can end.

Embodiments can provide for sensing the halftone uniformity of a photoreceptor using a reduced cleaning field in order to stress the scratch defects. By lowering the cleaning field, the defect can be sensed prior to being seen by a customer using a normal cleaning field. This can enable accurate prediction of the impending failure of the photoreceptor. Knowing the near failure point can eliminate the need for a fixed service replacement interval. The entire failure distribution can be used to allow running the devices to near failure. Not only can this lower a fleet's parts replacement rate, but it can also lower the service cost portion of the run cost by eliminating the replacement interval of the photoreceptor device, which can result in a significant reduction in photoreceptor run cost over the current photoreceptor service strategy and devices.

For example, halftone uniformity becomes unacceptable when the surface roughness of a photoreceptor device reaches approximately 3.5. um using a Rz scale. The scratches induced are created by the Paschen breakdown that occurs between the charge transport layer of the photoreceptor and the tips of electrostatic brush fibers. While electrostatic brush cleaning has been shown to be very good for reducing the general wear of the charge transport layer or outer layer of the photoreceptor, electrostatic brushes do create excessive scratching of the photoreceptor drum surface due to the very small diameter fibers being used. Because the fiber diameter is so small, micro-arcing occurs, even at low bias levels of 400. to 600. volts. The photoreceptor can be overcoated with a more scratch resistant coating, which can delay the amount of cycles it takes to reach the 3.5. um Rz failure threshold and thus can improve the photoreceptor life. To achieve 90% reliability, with 90% confidence, the current, non-overcoated device must be replaced at 360. kcycles. The overcoat can extend this replacement interval to 639. kcycles. This increase in life offers a limited reduction in the photoreceptor run cost. Both the non-overcoated and overcoated devices require a high frequency service item replacement rate to ensure the 90% reliability target is met. Thus, there still exists a need for service labor, even with the longer life photoreceptor. To gain a much larger reduction in run cost, the service labor cost associated with the photoreceptor replacement can be attacked and eliminated. To accomplish this, a sensing strategy can be used to allow the machine to indentify when the photoreceptor is about to reach its end of life due to excessive scratching.

Halftone performance can be quantified by the use of a vertical banding score that is acquired using an image quality analysis station. At a normal cleaning field used in customer operation of around 120. volts, the vertical banding score increases from 2.1, to 3.0, to 3.7. as the surface roughness of the drum increases from 3.0, 3.5 and 4.0, respectively. Reducing the cleaning field can increase the severity of the halftone non-uniformity. By reducing the cleaning field, the halftone uniformity can be artificially made worse in order to sense when the device will fail at a normal cleaning field. A full width array sensor or other sensor can replace an image quality analysis scanner. Additionally, other techniques that can be used to measure cross-process non-uniformity of the image could also be incorporated as a replacement to the image quality analysis scanner. The machine's process control system can intentionally lower the cleaning field by reducing the charge voltage. A halftone image can be generated and scanned by the sensor. A metric similar to the vertical banding score used in image quality analysis can be generated by the sensor and stored in non-volatile memory. When the uniformity reaches a failure point at reduced cleaning field, a flag or message can be sent to a user interface instructing a user that the photoreceptor needs replacing. Additionally, continual measurements can be made and a projection point in the future can be calculated to let the user know roughly when in the future the failure might occur, thereby enabling them to manage the replacement based on any long, critical jobs that are coming up. The user can then replace the device when convenient, or a service engineer can replace the device if he/she is there for another reason. This sensing technique not only can lower the photoreceptor replacement rate and lowers the parts cost, but it also can lower the service labor hours by elimination of the high frequency service item fixed replacement interval. In other words, the labor associated with replacing the part prematurely can also be eliminated. The use of a sensor and a lower cleaning field to predict imminent failure and replacement when the device is near the failure point can offer a significant reduction in run cost over both the non-overcoated and overcoated photoreceptor devices.

Embodiments may be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. A method of operating a xerographic printing apparatus, the xerographic printing apparatus including a rotatable photoreceptor having a photoreceptor surface, a cleaning device for removing marking material from the photoreceptor, and a printing apparatus controller that controls operations of the xerographic printing apparatus, the method comprising:

charging the photoreceptor surface to a fixed voltage, discharging at least a portion of the charged photoreceptor surface to an exposed voltage;

developing the discharged portion of the photoreceptor surface by providing a cleaning field between the charged photoreceptor surface fixed voltage and a developing bias voltage;

reducing the cleaning field;

generating a developed image on the photoreceptor using the reduced cleaning field; and scanning the developed image after reducing the cleaning field, where the developed image is scanned using a sensor to generate a scanned image.

2. The method according to claim 1, further comprising determining upcoming photoreceptor failure based on the scanned image.

3. The method according to claim 2, wherein determining comprises determining upcoming photoreceptor failure by determining image uniformity has reached a failure point based on the scanned image.

4. The method according to claim 1, wherein reducing the cleaning field comprises reducing the charged voltage of the photoreceptor.

5. The method according to claim 1, further comprising outputting an indicator that indicates upcoming photoreceptor replacement.

6. The method according to claim 1, wherein the photoreceptor includes a photoreceptor charge transport surface.

7. The method according to claim 6, wherein the cleaning device comprises at least one of an electrostatic cleaning brush and a cleaning blade coupled to the photoreceptor charge transport surface.

8. The method according to claim 1, wherein reducing the cleaning field comprises reducing the charge voltage of the photoreceptor to operate the xerographic printing apparatus using the reduced cleaning field and to decrease halftone uniformity.

9. The method according to claim 1, wherein generating comprises generating a developed image on the photoreceptor while operating the xerographic printing apparatus using the reduced cleaning field, wherein scanning the developed image comprises taking multiple measurements of the developed image using a sensor; and wherein the method further comprises projecting upcoming photoreceptor failure based on the multiple measurements.

10. A xerographic printing apparatus comprising:

a photoreceptor including a photoreceptor surface, the photoreceptor configured to generate an image on media;

a charge device configured to charge the photoreceptor surface to a fixed voltage;

a raster output scanner configured to discharge at least a portion of the charged photoreceptor surface to an exposed voltage;

a developer unit configured to develop the discharged portion of the photoreceptor surface by providing a cleaning field between the charged photoreceptor surface fixed voltage and a developing bias voltage;

a printing apparatus controller configured to control operations of the xerographic printing apparatus, configured to reduce the cleaning field, and configured to generate a developed image on the photoreceptor using the reduced cleaning field; and a sensor configured to scan the developed image after reducing the cleaning field to generate a scanned image.

11. The xerographic printing apparatus according to claim 10, wherein the printing apparatus controller is configured to determine upcoming photoreceptor failure based on the scanned image.

12. The xerographic printing apparatus according to claim 11, wherein the printing apparatus controller is configured to determine upcoming photoreceptor failure by determining image uniformity has reached a failure point based on the scanned image.

13. The xerographic printing apparatus according to claim 10, wherein the charge device comprises a scorotron, wherein the printing apparatus controller is configured to reduce the cleaning field by reducing the photoreceptor fixed voltage between the scorotron and the photoreceptor.

14. The xerographic printing apparatus according to claim 10, wherein the printing apparatus controller is configured to output an indicator that indicates upcoming photoreceptor replacement.

15. The xerographic printing apparatus according to claim 10, further comprising a cleaning device coupled to the photoreceptor surface.

16. The xerographic printing apparatus according to claim 15, wherein the cleaning device comprises at least one of an electrostatic cleaning brush and a cleaning blade coupled to the photoreceptor surface.

17. The xerographic printing apparatus according to claim 10, wherein the printing apparatus controller is configured to reduce the cleaning field to operate the xerographic printing apparatus using a reduced cleaning field to decrease halftone uniformity.

18. The xerographic printing apparatus according to claim 10, wherein the printing apparatus controller is configured to generate an image on the photoreceptor while operating the xerographic printing apparatus using the reduced cleaning field, configured to take multiple measurements of the image using a sensor, and configured to determine upcoming photoreceptor failure by projecting upcoming photoreceptor failure based on the multiple measurements.

19. A method in a xerographic printing apparatus, the xerographic printing apparatus including a photoreceptor having a photoreceptor surface, a photoreceptor cleaner that cleans the photoreceptor, and a printing apparatus controller that controls operations of the xerographic printing apparatus, the method comprising:

charging an area of the photoreceptor surface to a fixed voltage, discharging at least a portion of the charged photoreceptor surface to an exposed voltage;

developing the discharged portion of the photoreceptor surface by providing a cleaning field between the charged photoreceptor surface fixed voltage and a developing bias voltage;

reducing the cleaning field;

generating a developed image on the photoreceptor using the reduced cleaning field;

scanning the developed image after reducing the cleaning field, where the image is scanned to generate a scanned image; and determining upcoming photoreceptor failure based on a measured halftone uniformity of the scanned image.

20. The method according to claim 19, wherein developing further comprises generating a cleaning field between the charged area of the photoreceptor surface and a developing assembly.

* * * * *